United States Patent [19]

Tobben et al.

[11] Patent Number: 4,596,974

[45] Date of Patent: Jun. 24, 1986

[54] TRANSFORMER COMPRISING COAXIAL COIL FORMERS

[75] Inventors: Johannes H. Tobben; Johan L. Palmen, both of Eindhoven, Netherlands

[73] Assignee: U.S. Philips Corporation, New York, N.Y.

[21] Appl. No.: 720,913

[22] Filed: Apr. 8, 1985

[30] Foreign Application Priority Data

Apr. 13, 1984 [NL] Netherlands ..... 8401185

[51] Int. Cl.[4] ..... H01F 27/30

[52] U.S. Cl. ..... 336/197; 336/198; 336/210

[58] Field of Search ..... 336/198, 208, 210, 197, 336/192; 242/118.41; 310/194

[56] References Cited

U.S. PATENT DOCUMENTS 3,652,968 3/1972 Johnston et al. ..... 336/208

FOREIGN PATENT DOCUMENTS 97599 1/1984 European Pat. Off. ..... 336/198
2006736 8/1971 Fed. Rep. of Germany ..... 336/208
3222027 12/1983 Fed. Rep. of Germany ..... 336/192

*Primary Examiner*—Thomas J. Kozma
*Attorney, Agent, or Firm*—Robert T. Mayer; Bernard Franzblau

[57] ABSTRACT

A transformer comprising an outer coil former (1) having a first outer end portion (13), to which is secured a resilient device (49) which exerts a force on a first core part (47) directed towards a second outer end portion (15) of the outer coil former. Within the outer coil former (1) is arranged an inner coil former (3) having a first inner end portion (25), which is received by a recess in the first outer end portion (13) in a manner such that the resilient device engages only the first outer end portion and the first core part (47) but does not engage the first inner end portion. As a result, the resilient device not only holds the first core part in position, but also prevents the two coil formers (1,3) from moving away from each other.

4 Claims, 3 Drawing Figures

TRANSFORMER COMPRISING COAXIAL COIL FORMERS

BACKGROUND OF THE INVENTION

This invention relates to a transformer comprising:

(a) an outer coil made of an electrically insulating material and having a tubular central part on which is provided an outer winding space that extends between a first and a second outer end portion, (b) an inner coil former made of an electrically insulating material and having a tubular central part on which is provided an inner winding space that extends between a first and a second inner end portion, which inner coil former has been inserted through an opening provided in the first outer end portion into the interior of the central part of the outer coil former in a manner such that both the two first end portions and the two second end portions engage each other, and (c) a multi-part ferromagnetic core, having a first core part with a limb inserted through openings in the first end portions into the interior of the central part of the inner coil former.

Such a transformer is known from the Dutch Patent Application No. 7204034 laid open to public inspection. The manner in which the core parts are secured in the inner coil former is not described herein. One usual method by which this can be effected is to glue the two core parts to each other. However, this method is time-consuming and less suitable for a mechanized mounting process.

SUMMARY OF THE INVENTION

The invention has for an object to provide a transformer of the kind mentioned in the opening paragraph in which the core can be secured very rapidly and in a simple manner.

The transformer according to the invention is characterized for this purpose in that at least the first outer end portion has secured to it a resilient device which exerts on the first core part a force directed towards the second outer end portion and in that the first outer end portion has a recess for receiving at least a part of the first inner end portion in a manner such that the resilient device engages only the first outer end portion and the first core part but does not engage the first inner end portion.

A preferred embodiment of the transformer according to the invention is characterized in that the point at which the resilient device engages the first core part is closer to the axis of the assembly of the coil formers than the points at which the resilient device engages the first outer end portion.

It should be noted that the method of mounting the core parts by means of a resilient device engaging the relevant core part and an end portion of a coil former has been previously suggested for a coil comprising a simple coil former in German Patent Application No. 3,235,655. However, this method is not suitable without further expedients for a transformer comprising two coil formers arranged coaxially one in the other because, without further steps being taken, the two coil formers would be pulled away from each other by the resilient devices. In the transformer according to the invention, the two coil formers on the contrary are pressed against each other by the resilient device engaging the first core part so that a firm construction is obtained.

In order to hold the two coil formers together before the core parts and the resilient device are provided, a further preferred embodiment of the transformer according to the invention is characterized in that the inner and the outer coil former are provided with snap connection means for immovably holding the inner coil former in the outer coil former.

BRIEF DESCRIPTION OF THE DRAWING

The invention will now be described more fully with reference to the drawing. In the drawing.

DESCRIPTION OF THE PREFERRED EMBODIMENT

Figure 1:
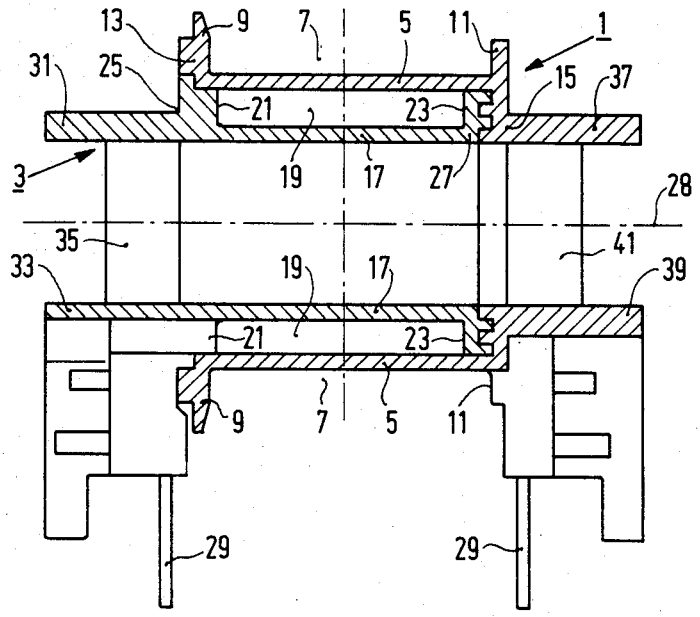
FIG. 1 is a longitudinal sectional view of two coil formers arranged coaxially one within the other which are suitable to be used in a transformer according to the invention.
Figure 2:
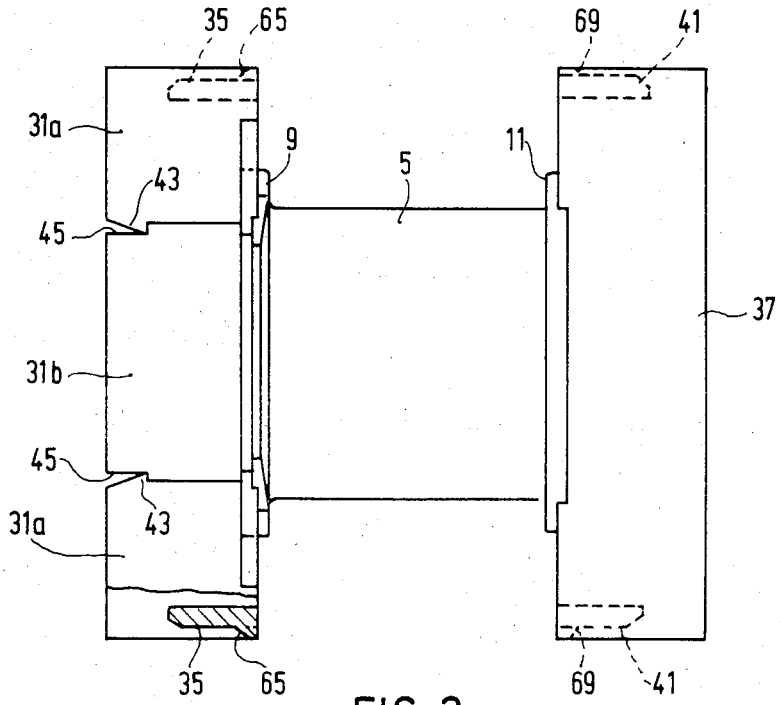
FIG. 2 is a plan view of the coil formers shown in FIG. 1.

The outer coil former 1 and inner coil former 3 shown in FIGS. 1 and 2 are formed from an electrically insulating material, for example, a thermo-setting synthetic material. The outer coil former 1 has a tubular central part 5 on which is provided an outer winding space 7 bounded by a first outer flange 9 and a second outer flange 11 which form part of a first outer end portion 13 and a second outer end portion 15, respectively. The inner coil former 3 has a tubular central part 17 on which is provided an inner winding space 19 bounded by a first inner flange 21 and a second inner flange 23 which form part of a first inner end portion 25 and a second inner end portion 27, respectively. Transformer coils can be wound in the winding spaces 7,19.

The inner coil former 3 is inserted through an opening provided in the first outer end portion 13 into the interior of the central part of the outer coil former 1 in a manner such that a coaxial assembly is obtained, whose axis is designated by reference numeral 28. The dimensions of the two coil formers 1,3 are chosen so that the two first end portions 13,25 and the two second end portions 15,27 respectively engage each other when the inner coil former is inserted entirely within the outer coil former. As a result, the inner winding space 19 is substantially entirely closed so that a coil wound therein is electrically insulated from the surrounding and also from a coil wound in the outer winding space 7. This is of importance, for example, when the first-mentioned coil is the primary coil of a supply transformer to be connected to the mains. In this case, stringent safety requirements are often imposed on the insulation of the transformer primary coil. These requirements specify also a minimum length for the creepage paths existing between this coil and its surroundings. In order to satisfy these requirements, the surfaces engaged of the end portions 13,25 and 15,27, respectively, are provided with a stepped profile.

In the second outer end portion 15 and in the first inner end portion 25 are secured connection pins 29 which can be connected to connection wires of the coils. The assembly of the two coil formers 1,3 further comprises a first framework (on the lefthand side in FIGS. 1 and 2) which is constituted by an upper plate 31, a lower plate 33 and two side plates 35, and a second framework (on the righthand side in FIGS. 1 and 2) which is constituted by an upper plate 37, a lower plate 39 and two side plates 41. The second frame work as a whole forms part of the second outer end portion 15. The first frame work is partly integral with the first outer end portion 13 and partly integral with the first inner end portion 25. This can be seen clearly in FIG. 2. The upper plate 31 of the first framework is composed of two side parts 31*a* and a central part 31*b*, while the lower plate 33 is subdivided in a corresponding manner into two side parts 33*a* and a central part 33*b* which is integral with two laterally extending contact strips in which some of the connection pins 29 are secured (see FIG. 3). The parts 31*a* and 33*a* together with the side plates 35 form part of the first outer end portion 13.

Figure 3:
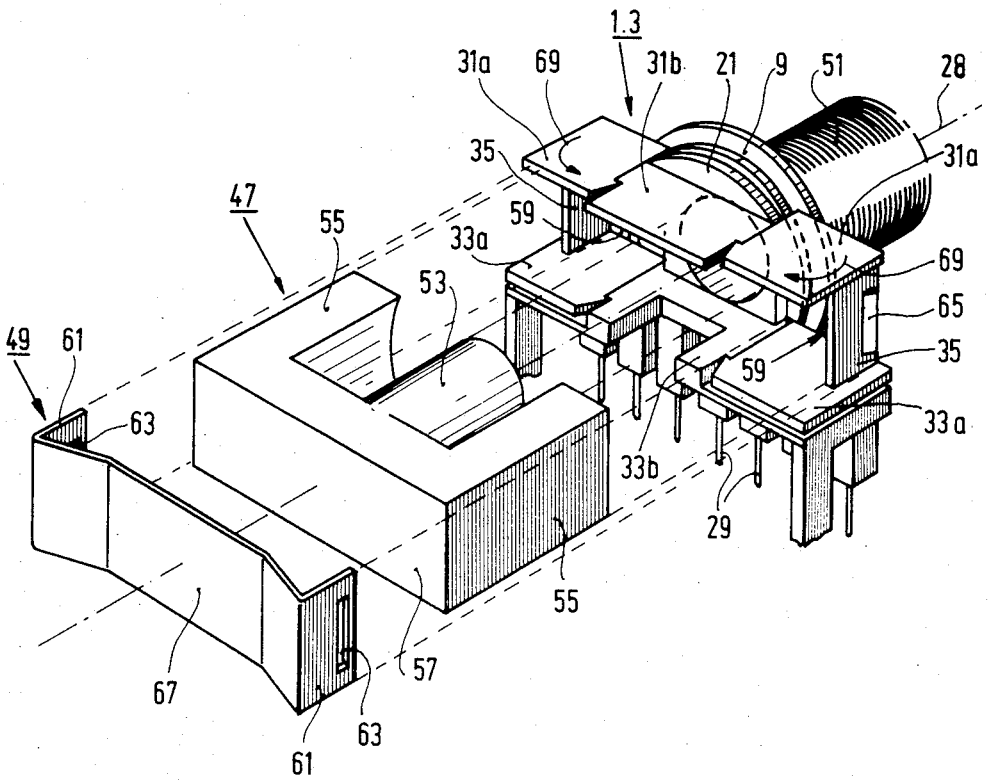
FIG. 3 shows, partly as an exploded view, an embodiment of a transformer according to the invention.

It can be seen clearly in FIG. 3 that a recess receiving the parts 31*b* and 33*b* is provided between the lefthand side plate 35 with the associated parts 31*a*,33*a* on the one hand and the righthand side plate 35 with the associated parts 31*a*,33*a* on the other hand. The parts received by the recess form part of the first inner end portion 25, of which, due to this construction, the part forming part of the first framework does not project in a lateral direction beyond the first outer end portion 13.

There are formed on the side parts 31*a* barb shaped hooks 43 which form snap-connections together with recesses 45 in the central part 31*b*. In a similar manner, snap connections are formed at the side parts 33*a* and the central part 33*b* of the lower plate 33. These snap connections serve to prevent the inner coil former 3 from slipping out of the outer coil former 1. The coil formers 1,3 are preferably made of a thermo-setting synthetic material so that they have a higher resistance to deformation than coil formers made of a thermoplastic synthetic material. Consequently, the resilient properties also desired for a satisfactory operation of a snap connection are obtained to a lesser extent, it is true, but in the present case this is not disadvantageous because, as will be explained hereinafter, the snap connection need fulfil its function only until the transformer core has been mounted.

FIG. 3 is an exploded view of a part of the assembly of the coil formers 1,3 (the lefthand part in FIGS. 1 and 2) showing an E-shaped first part 47 of a ferromagnetic core and a resilient device 49 for securing same. Coils, of which the outer coil 51 is visible, are wound onto the coil formers 1,3. Subsequently, the coil formers are inserted one into the other so that they are held in the position shown in the Figures by the snap connections 43,45.

The first core part 47 consists of a central limb 53, two side limbs 55 and a yoke 57 interconnecting the limbs. The central limb is inserted during mounting through openings in the first end portions 13,25 into the interior of the central part 17 of the inner coil former 3. In a similar manner, a correspondingly formed second core part (not shown) is inserted with its central limb through openings in the second end portions 15,27 into the central part 17 of the inner coil former 3. The side limbs 55 of the first core part 47 are inserted through openings 59 between the side plates 35 and the outer flange 9. The side limbs of the second core part are inserted through corresponding openings between the side plates 41 and the second flange 11. The ends of the corresponding limbs of the two core parts touch each other after the core parts have been entirely inserted into the coil formers 1,3 so that a closed magnetic circuit is formed. If desired, one of the limbs may be chosen to be slightly shorter than the other so that an air gap of predetermined dimensions is formed.

The resilient device 49 in this embodiment consists of a spring-clip, whose two rectangular ends 61 are bent and are provided with apertures 63 adapted to cooperate for securing the spring clip with projections 65 which are formed on the side plates 35. After the first core part 47 has been inserted into the coil formers, the spring clip is pressed with its central part 67 against the back of the yoke 57, the ends 61 sliding over the projections 65 until the projections fall into the apertures 63. Due to the fact that the point at which the resilient device 49 engages the yoke 57 is closer to the axis 28 of the assembly of the coil formers 1,3 than the points at which this device engages the first outer end portion 13, a torque is exerted on each of the parts of the first framework forming part of the first outer end portion in the direction of the arrow 69. As a result, the recess between these parts is deformed in such a manner that it becomes slightly wedge-shaped. The parts 31*b* and 33*b* received by this recess are consequently clamped between the parts 31*a* and 33*a*, respectively. This results in the inner coil former 3 being held in its position within the outer coil former 1. The function of the snap connections 43,45 is therefore taken over by the resilient device 49. This is possible due to the fact that the projections 65, to which the resilient device 49 is secured, are located on the side plates 35 which form part of the first outer end portion 13. The resilient device 49 and a correspondingly formed resilient device (not shown) which is secured to projects 69 on the side plates 41 of the second outer end portion 15 consequently both engage the outer coil former 1. If the resilient device 49 was secured to the inner coil former 3, the coil formers 1 and 3 would be pulled away from each other due to the fact that each of the resilient devices exerts a force which drives the relevant core part inwards and consequently drives the relevant coil former outwards. Since the limbs of the core parts engage each other so that they cannot move further inwards, in this case the coil formers would move away from each other. Therefore, it is of major importance that the first outer end portion has recess by which the first inner end portion 25 is received in a manner such that the resilient device 49 engages only the first outer end portion and the first core part 47 and does not engage the first inner end portion. The resilient device 49 can further press the front side of the yoke 57 against the outer side of the first inner flange 21, as a result of which the clamping action described above can be favoured or even taken over.

In the embodiment shown, the resilient device 49 has the form of a spring clip with rectangularly bent ends. It will be appreciated that other embodiments are also possible, for example a plate or bracket not resilient in itself, to whose central part a helical spring is secured and which is inserted into grooves at the side of the first outer end portion. The second core part may be secured, if desired, by non-resilient means to the second outer end portion 15. If desired, instead of using a core comprising two E-shaped parts, an alternative bi- or multi-part core may be used, for example a core comprising two C-shaped parts.

What is claimed is:

1. A transformer comprising:

(a) an outer coil former made of electrically insulating material and having a tubular central part on which is provided an outer winding space that extends between a first and a second outer end portion, (b) an inner coil former made of electrically insulating material and having a tubular central part on which is provided an inner winding space that extends between a first and a second inner end portion, said inner coil former having been inserted through an opening provided in the first outer end portion into the interior of the central part of the outer coil former in a manner such that the two first end portions and the two second end portions respectively engage each other, (c) a multi-part ferromagnetic core having a first core part with a limb inserted through openings in the first end portions into the interior of the central part of the inner coil former, characterized in that at least the first outer end portion has secured to it a resilient device which exerts on the first core part a force directed towards the second outer end portion and in that the first outer end portion has a recess for receiving at least a part of the first inner end portion in a manner such that the resilient device engages only the first outer end portion and the first core part but does not engage the first inner end portion.

2. A transformer as claimed in claim 1, characterized in that the point at which the resilient device engages the first core part is closer to the axis of the assembly of the coil formers than the points at which the resilient device engages the first outer end portion.

3. A transformer as claimed in claim 1 wherein the inner and the outer coil former are provided with snap connection means for immovably holding the inner coil former in the outer coil former.

4. A transformer as claimed in claim 2 wherein the inner and the outer coil former each comprise snap connection means for fastening the inner coil former in the outer coil former.

* * * * *